US010690438B1

(12) United States Patent
Wei

(10) Patent No.: US 10,690,438 B1
(45) Date of Patent: Jun. 23, 2020

(54) TOY GUN WITH SLIDE STOPPING MECHANISM

(71) Applicant: Ho-Sheng Wei, New Taipei (TW)

(72) Inventor: Ho-Sheng Wei, New Taipei (TW)

( * ) Notice: Subject to any disclaimer, the term of this patent is extended or adjusted under 35 U.S.C. 154(b) by 0 days.

(21) Appl. No.: 16/457,644

(22) Filed: Jun. 28, 2019

(51) Int. Cl.
*F41B 11/70* (2013.01)
*F41B 11/54* (2013.01)
*F41B 11/89* (2013.01)
*F41B 11/60* (2013.01)

(52) U.S. Cl.
CPC ..... *F41B 11/70* (2013.01); *F41B 11/54* (2013.01); *F41B 11/60* (2013.01); *F41B 11/89* (2013.01)

(58) Field of Classification Search
CPC ... A63H 5/04; F41B 11/89; F41B 7/08; F41B 11/70; F41B 11/54; F41B 11/60; F41B 11/00
USPC ..... 124/63
See application file for complete search history.

(56) References Cited

U.S. PATENT DOCUMENTS 1,314,013 A * 8/1919 Mulvey ..... F41A 9/73 42/19
2,086,339 A * 7/1937 Sosso ..... F41A 9/65 42/49.01
2,237,678 A * 4/1941 Lohr ..... F41A 9/28 124/66
4,468,875 A * 9/1984 Harrison ..... F41A 9/76 42/50
4,986,251 A * 1/1991 Lilley ..... F41B 11/54 124/48
5,295,320 A * 3/1994 Svensson ..... F41A 9/76 42/49.01
5,592,931 A * 1/1997 Johnson ..... F41B 11/54 124/48
6,530,368 B1 * 3/2003 Maeda ..... F41B 11/55 124/48
6,736,125 B2 * 5/2004 Petrosyan ..... F41B 11/55 124/51.1
7,552,668 B1 * 6/2009 Gonzalez ..... F42B 33/00 86/45
7,765,997 B2 * 8/2010 Klockener ..... F41A 9/76 124/48
9,612,081 B2 * 4/2017 Maeda ..... F41B 11/55
9,835,405 B2 * 12/2017 Maeda ..... F41B 11/89
9,835,406 B2 * 12/2017 Maeda ..... F41B 11/642
10,371,473 B1 * 8/2019 Wei ..... F41B 11/55
10,393,472 B1 * 8/2019 Wei ..... F41B 11/51
10,408,556 B2 * 9/2019 Dottle ..... F41A 33/02
(Continued)

*Primary Examiner* — Joshua E Freeman
(74) *Attorney, Agent, or Firm* — Chun-Ming Shih; HDLS IPR Services

(57) ABSTRACT

A toy gun includes a gun body (1), a slide (2), a slide stopper (3), a return spring (4), a retainer (5), and a rotary bullet supplier (6). The slide (2) is disposed on the gun body (1) and reciprocates against the gun body (1). The slide stopper (3) is pivotedly connected to the gun body (1) and arranged correspondingly to the slide (2). The return spring (4) elastically supports between the gun body (1) and the slide stopper (3). The retainer (5) is pivotedly connected to the gun body (1). An end of the retainer (5) engages with the slide stopper (3), and another end thereof connects with a first magnetic member (51). The rotary bullet supplier (6) is received in the gun body (1) and connects with a second magnetic member (61).

10 Claims, 7 Drawing Sheets

(56) References Cited

U.S. PATENT DOCUMENTS

| | | | | |
|---|---|---|---|---|
| 2002/0092514 | A1* | 7/2002 | Salva | F41B 11/54 124/71 |
| 2002/0139362 | A1* | 10/2002 | Shipachev | F41B 11/56 124/74 |
| 2004/0079352 | A1* | 4/2004 | Piccini | F41A 9/73 124/49 |
| 2006/0213493 | A1* | 9/2006 | Shih | F41B 11/00 124/80 |
| 2009/0151710 | A1* | 6/2009 | Zimmerman | F41B 11/89 124/48 |
| 2018/0164068 | A1* | 6/2018 | Huang | F41B 11/54 |
| 2019/0301824 | A1* | 10/2019 | Maeda | F41A 17/56 |

* cited by examiner

TOY GUN WITH SLIDE STOPPING MECHANISM

BACKGROUND OF THE INVENTION

Technical Field

The invention relates to toy guns, particularly to a toy gun with a slide stopping mechanism.

Related Art

People in modern society are always busy and tense, so many people select recreational actions to resolve the usual pressure. More and more people select fresh and exiting recreational actions. As a result, toy guns, such as BB guns, paintball guns and air guns, become an important tool for shoot training.

However, conventional toy guns usually utilize the pressure released by a gas cylinder to shoot bullets inside the gun. When a trigger is continuously pulled, firing will not stop until the pressure released by the gas cylinder is totally exhausted. As a result, remaining gas in the gas cylinder will be constantly consumed after bullets in a magazine has been exhausted. This causes waste of gas in a gas cylinder.

SUMMARY OF THE INVENTION

An object of the invention is to provide a toy gun with a slide stopping mechanism, whose first magnetic member attracts or repels a second magnetic member to drive a slide stopper to engage with a slide so as to immediately stop firing and save gas in a gas cylinder when bullets in a rotary bullet supplier are exhausted.

To accomplish the above object, the invention provides a toy gun includes a gun body, a slide, a slide stopper, a return spring, a retainer, and a rotary bullet supplier. The slide is disposed on the gun body and reciprocates against the gun body. The slide stopper is pivotedly connected to the gun body and arranged correspondingly to the slide. The return spring elastically supports between the gun body and the slide stopper. The retainer is pivotedly connected to the gun body. An end of the retainer engages with the slide stopper, and another end thereof connects with a first magnetic member. The rotary bullet supplier is received in the gun body and connects with a second magnetic member. When the first magnetic member attracts or repels the second magnetic member, the slide stopper is driven to separate from the retainer to make the return spring push the slide stopper to return toward the slide until the slide stopper engages with the slide.

According to the abovementioned, the rotary bullet supplier defines a rotation direction. The first magnetic member is extended with a magnetic extending section in a direction which is opposite to the rotation direction. The magnetic extending section can perform attraction or repellence in advance when the second magnetic member is approaching the first magnetic member, and the first magnetic member will rapidly and accurately attract or repel the second magnetic member when the first magnetic member directly corresponds to the second magnetic member.

DETAILED DESCRIPTION OF THE INVENTION

Figure 1:
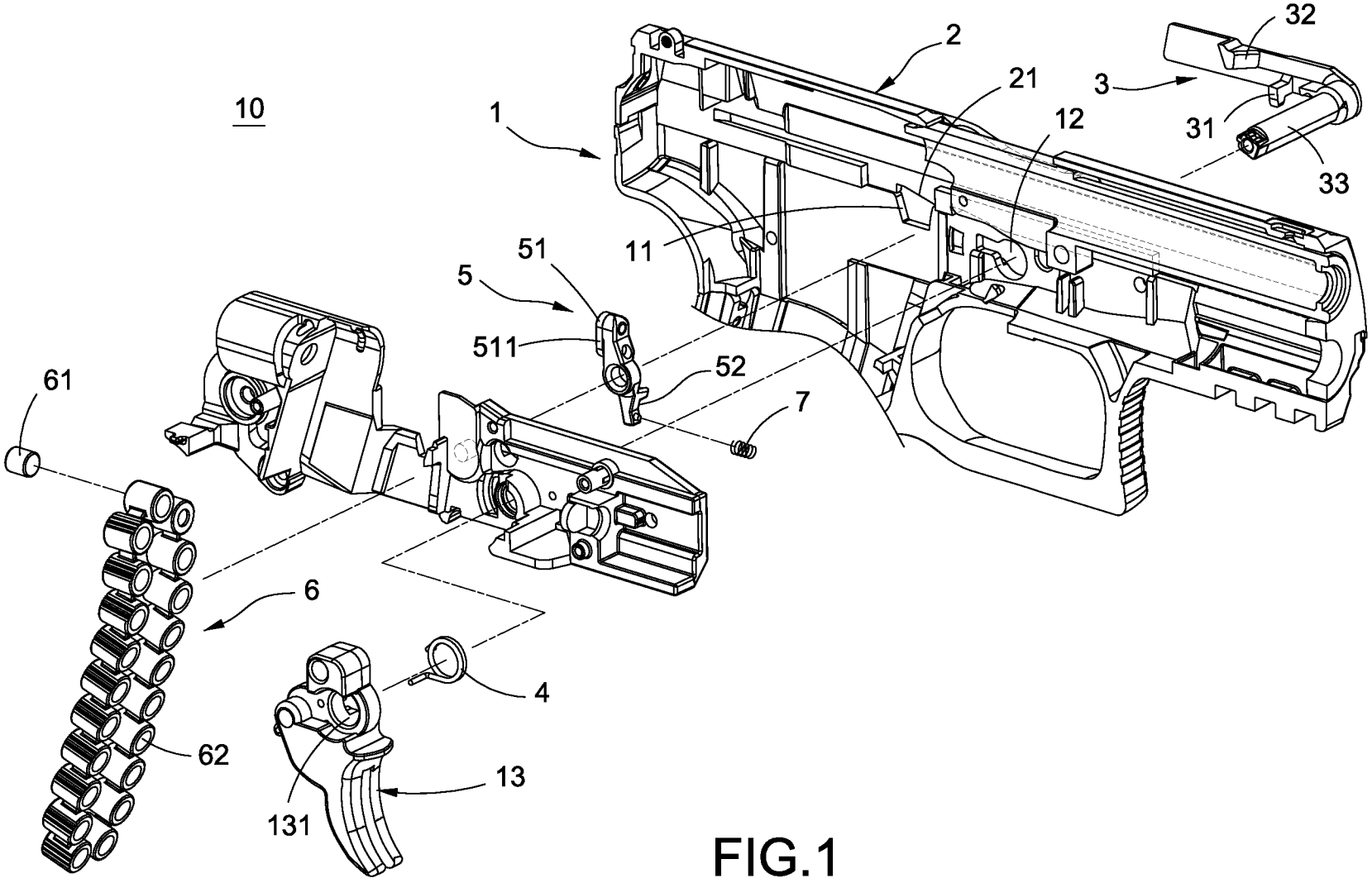
FIG. 1 is an exploded view of the toy gun of the invention.
Figure 3:
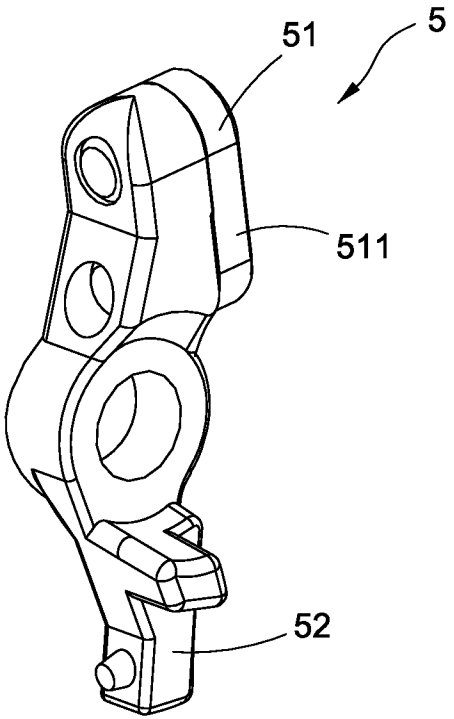
FIG. 3 is a perspective view of the retainer of the invention.
Figure 2:
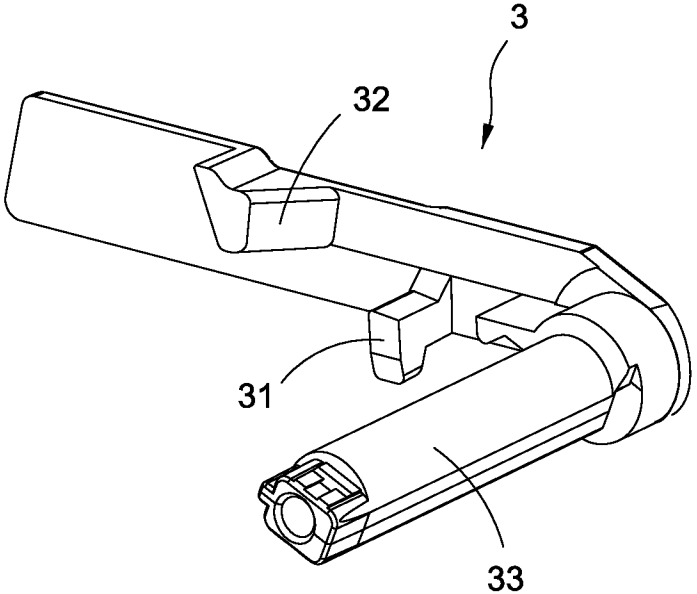
FIG. 2 is a perspective view of the slide stopper of the invention.

Please refer to FIGS. 1-8. The invention provides a toy gun with a slide stopping mechanism, which includes a gun body 1, a slide 2, a slide stopper 3, a return spring 4, a retainer 5, and a rotary bullet supplier 6.

As shown in FIGS. 1 and 5-8, the gun body 1 is formed with an aperture 11 and a first pivoting hole 12. The gun body 1 is further provided with a trigger 13 with a second pivoting hole 131. The slide 2 is installed on the gun body 1 and can reciprocate against the gun body 1. The slide 2 is formed with recesses 21.

As shown in FIGS. 1, 2 and 4-8, the slide stopper 3 is pivotedly connected to the gun body 1 and outside the gun body 1. The slide stopper 3 is arranged correspondingly to the slide 2 and can sway relative to the slide 2. The slide stopper 3 is extended with a first block 31, a stopping body 32 and a shaft 33. The stopping body 32 is movably received in the aperture 11 or movably engages with one of the recesses 21. In other words, the stopping body 32 can be received in the aperture 11 or the stopping body 32 can escape from the aperture 11 to engage with one of the recesses 21. The shaft 33 is rotatably received in both the first pivoting hole 12 and the second pivoting hole 131.

As shown in FIGS. 1, 4 and 6-7, the return spring 4 elastically supports between the gun body 1 and the slide stopper 3. The return spring 4 is a torsion spring, but not limited to this. Two ends of the return spring 4 are fixed to the trigger 13 and the shaft 33 for pushing the slide stopper 3 to return toward the slide 2.

As shown in FIGS. 1, 3, 4 and 6-7, the retainer 5 is pivotedly connected to the gun body 1. An end of the retainer 5 engages with the slide stopper 3, and another end thereof connects with a first magnetic member 51. The retainer 5 is extended with a second block 52 which movably engages with the first block 31.

As shown in FIGS. 1, 4 and 6-7, the rotary bullet supplier 6 is received in the gun body 1, rotates relative to the retainer 5 and connects with a second magnetic member 61.

In detail, the rotary bullet supplier 6 is a chain or wheel. The rotary bullet supplier 6 is provided with bullet loading holes 62. The second magnetic member 61 is inserted into one of the bullet loading holes 62.

In addition, the rotary bullet supplier 6 defines a rotation direction d. The first magnetic member 51 is extended with a magnetic extending section 511 in a direction which is opposite to the rotation direction d.

As shown in FIGS. 1, 4 and 6-7, the toy gun 10 further includes a restoring spring 7 which elastically supports between the gun body 1 and the retainer 5. In this embodiment, the restoring spring 7 is a spiral spring, but not limited to this. The restoring spring 7 pushes the retainer 5 to keep a restoring position of the second block 52 engaging with the first block 31.

Please refer to FIGS. 4-8, which show the toy gun 10 of the invention in use. When a user is continuously pulling the trigger 13, the slide 2 will reciprocate relative to the gun body 1 and drive a firing structure (not shown) in the gun body 1 to collide a valve of a gas cylinder (not shown). Meanwhile, the rotary bullet supplier 6 will rotate relative to the valve of the gas cylinder so that bullets (not shown) in the rotary bullet supplier 6 will be shot one by one.

Figure 4:
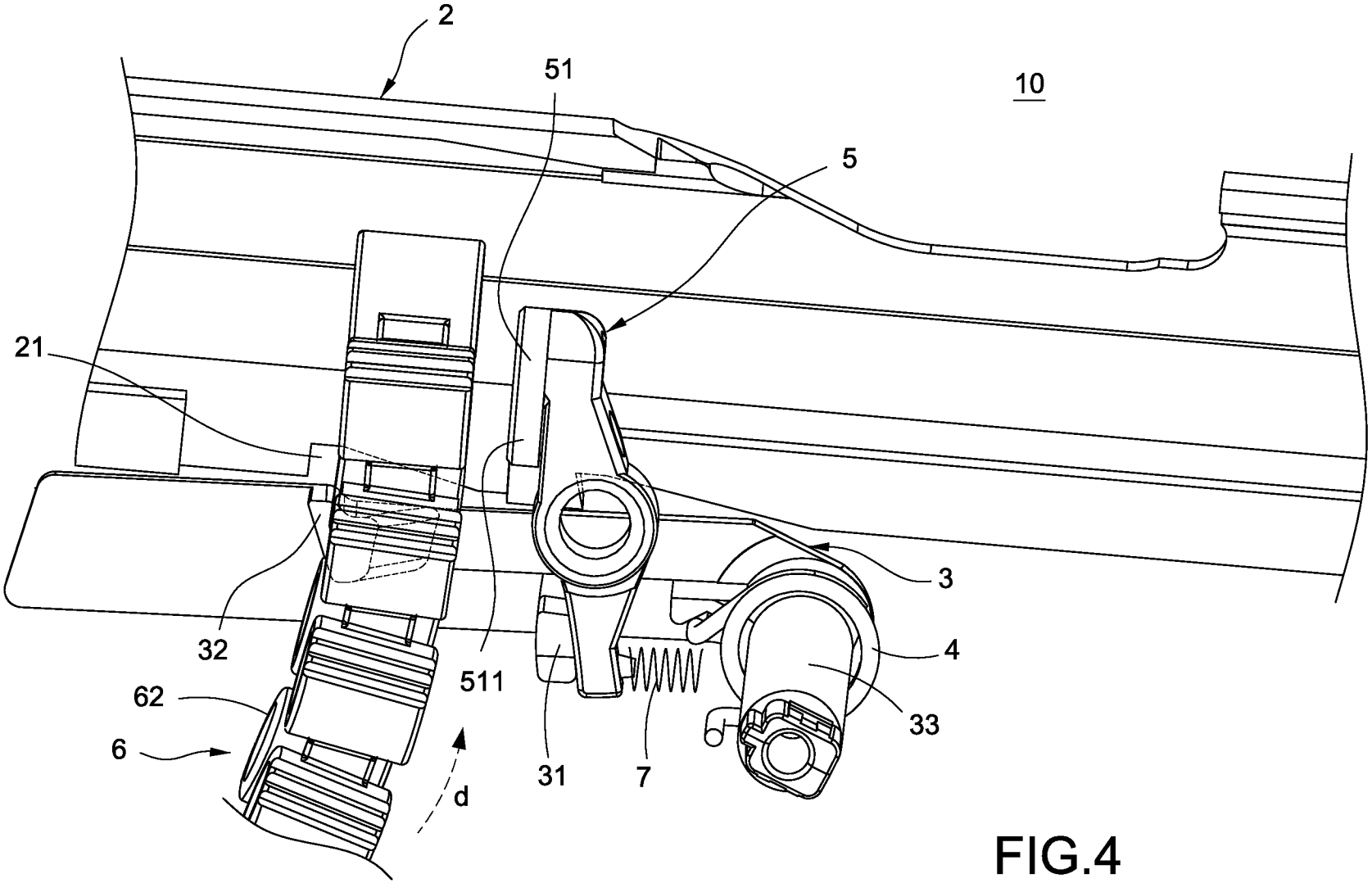
FIG. 4 is an assembled view of the toy gun of the invention.
Figure 5:
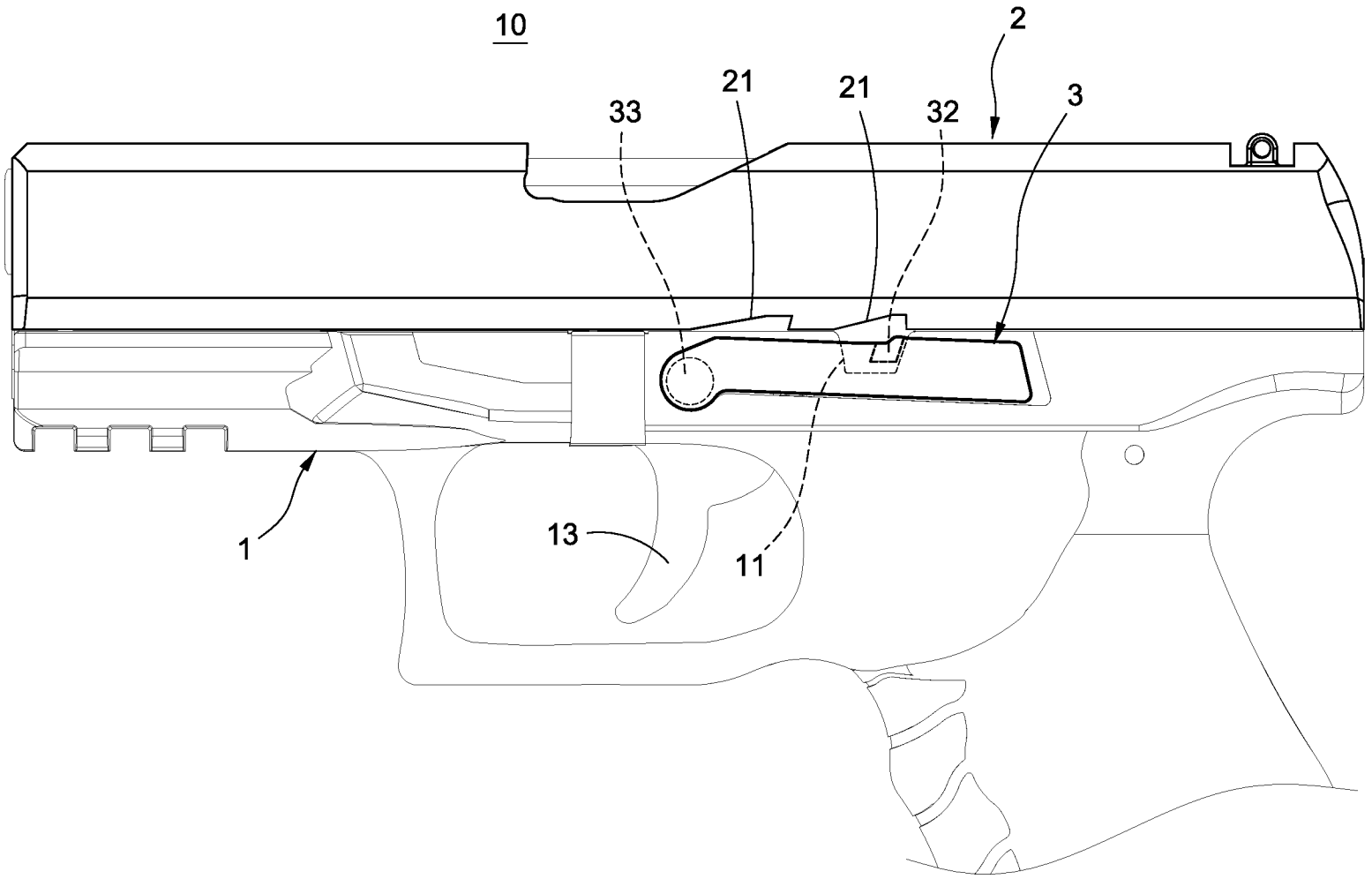
FIG. 5 is another assembled view of the toy gun of the invention.
Figure 6:
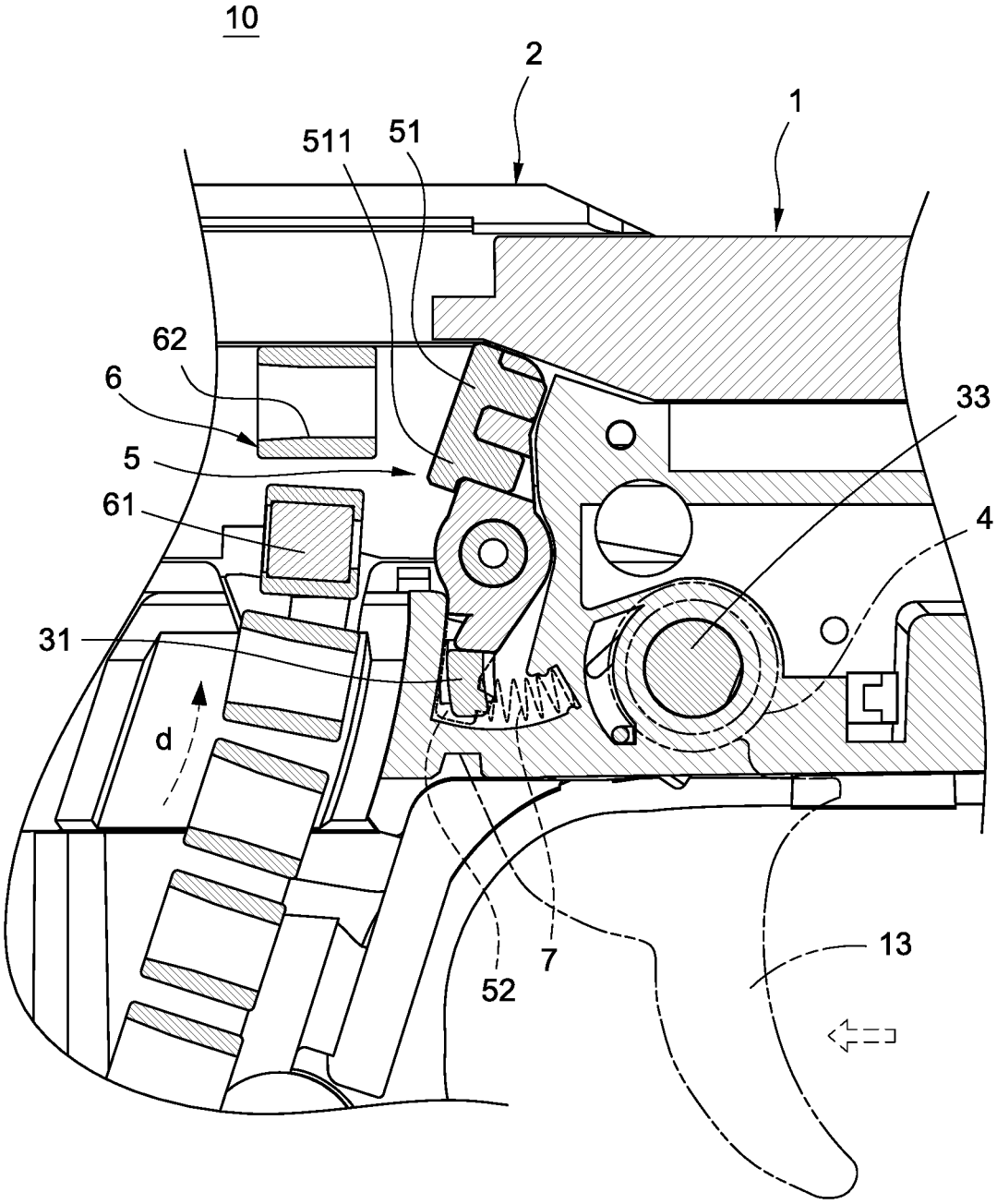
FIG. 6 is a schematic view of the toy gun of the invention in use.

First, as shown in FIGS. 4-6, when the stopping body 32 is received in the aperture 11, the first block 31 will move to a side of the second block 52 to make the retainer 5 keep at the restoring position of the second block engaging with the first block 31.

In this embodiment, either of the first and second magnetic members 51, 61 is a magnet and the other one is a metal piece which can be magnetically attracted, but not limited to this.

Figure 7:
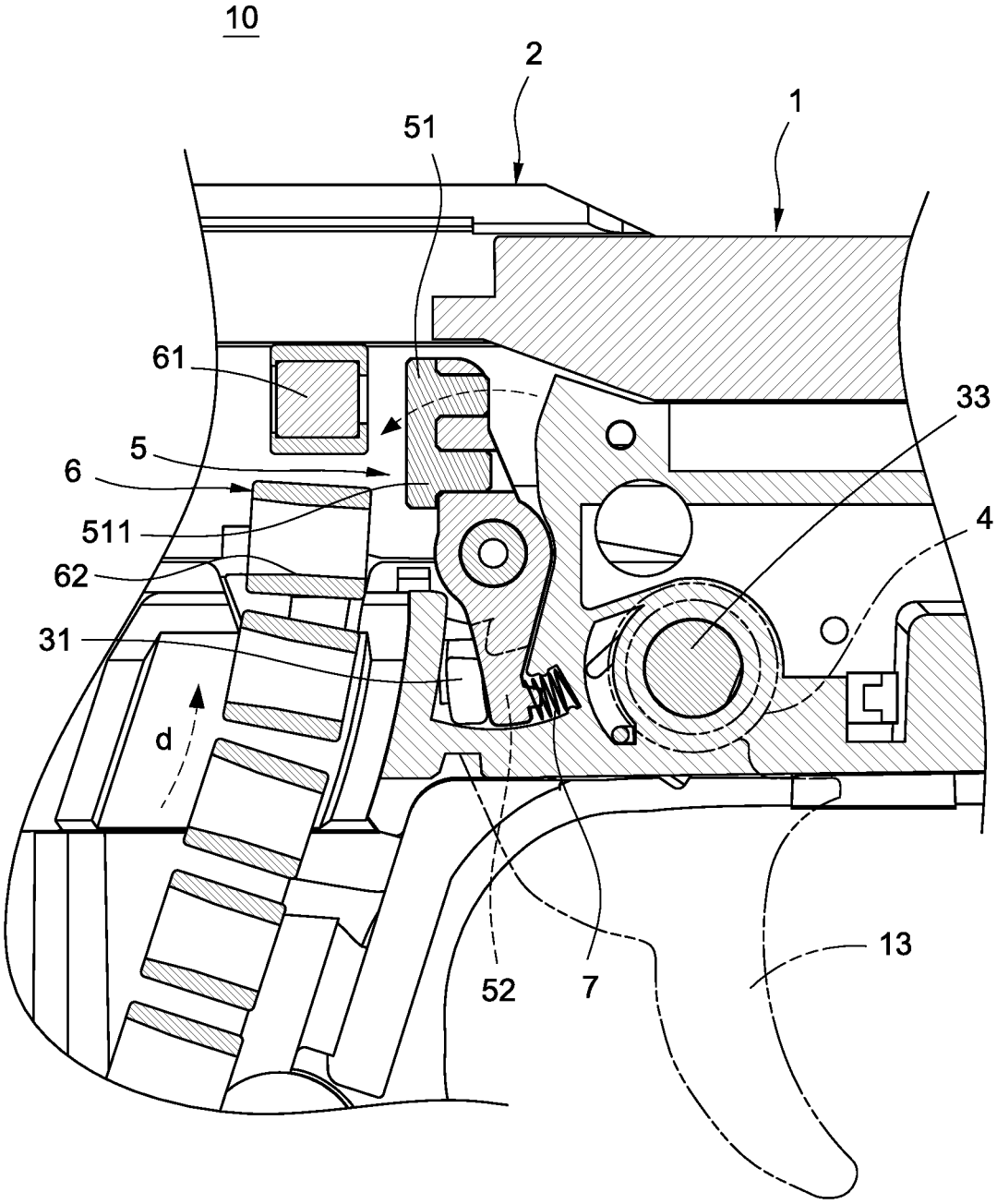
FIG. 7 is another schematic view of the toy gun of the invention in use.
Figure 8:
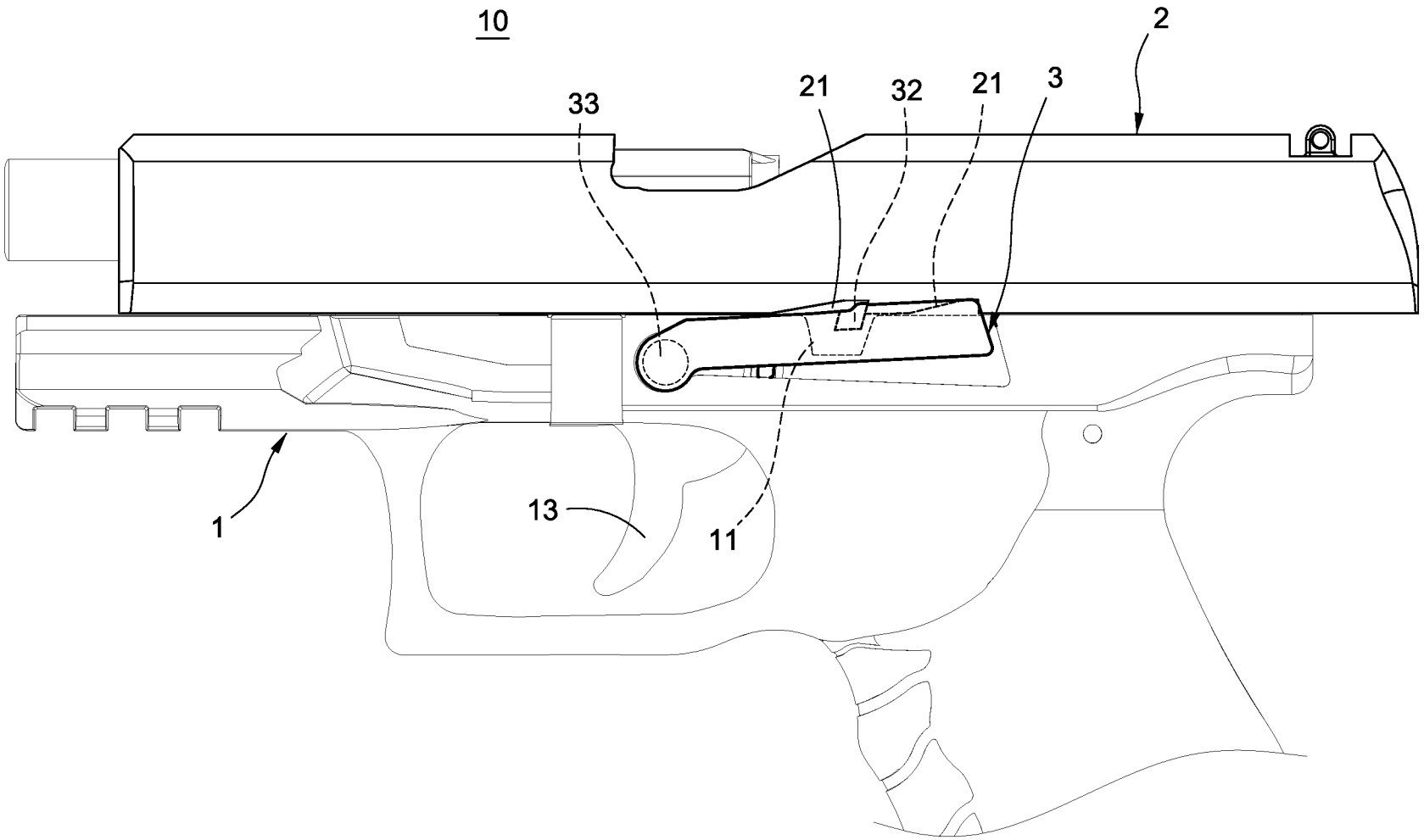
FIG. 8 is still another schematic view of the toy gun of the invention in use.

As shown in FIGS. 7-8, when there are bullets in the bullet loading holes 62 of the rotary bullet supplier 6, the bullets will be shot one by one until the rotary bullet supplier 6 is rotated to a position of the first magnetic member 51 aligning with the second magnetic member 62. At this time, the first magnetic member 51 and the second magnetic member 61 magnetically attract each other to drive the first block 31 of the slide stopper 3 to separate from the second block 52 of the retainer 5. After the slide stopper 3 is not contained by the retainer 5, the return spring 4 will push the slide stopper 3 to return toward the slide 2 until the stopping body 32 of the slide stopper 3 engages with one of the recesses 21. At this time, the slide 2 will be contained by the slide stopper 3 to be unmovable so that the firing structure in the gun body 1 will not be driven to collide the valve of the gas cylinder.

Similarly, the first and second magnetic members 51, 61 may also be two magnets with the same arrangement of magnetic polarity. Under this arrangement, when the first magnetic member 51 aligns with the second magnetic member 62, the first magnetic member 51 and the second magnetic member 61 magnetically repel each other to drive the first block 31 of the slide stopper 3 to separate from the second block 52 of the retainer 5, so that the return spring 4 will push the slide stopper 3 to return toward the slide 2 until the stopping body 32 of the slide stopper 3 engages with one of the recesses 21. As a result, the above effect and function can be accomplished.

When a trigger of a conventional toy gun is continuously pulled, firing will not stop until the pressure released by a gas cylinder is totally exhausted. This causes a problem of wasting gas in a gas cylinder. When bullets in the rotary bullet supplier 3 are exhausted, the first magnetic member 51 attracts or repels the second magnetic member 61, the slide stopper 3 is driven to separate from the retainer 5 to make the slide stopper 3 engage with the slide 2 to stop colliding the valve of the gas cylinder. As a result, gas in the gas cylinder can be saved because shooting can be immediately stopped once bullets are exhausted.

Besides, the first magnetic member 51 is extended with the magnetic extending section 511 in a direction which is opposite to the rotation direction d, so the magnetic extending section 511 can perform attraction or repellence in advance when the second magnetic member 61 is approaching the first magnetic member 51. Also, the first magnetic member 51 will rapidly and accurately attracts or repels the second magnetic member 61 when the first magnetic member 51 aligns with the second magnetic member 61.

Moreover, the stopping body 32 can selectively engage with any one of the recesses 21 so as to make the slide stopper 3 rapidly and accurately limit movement of the slide 2. This can immediately stop shooting and save gas in a gas cylinder.

It will be appreciated by persons skilled in the art that the above embodiment has been described by way of example only and not in any limitative sense, and that various alterations and modifications are possible without departure from the scope of the invention as defined by the appended claims.

What is claimed is:

1. A toy gun comprising:

a gun body (1);

a slide (2), disposed on the gun body (1), and reciprocating against the gun body (1);

a slide stopper (3), pivotedly connected to the gun body (1), and arranged correspondingly to the slide (2);

a return spring (4), elastically supporting between the gun body (1) and the slide stopper (3);

a retainer (5), pivotedly connected to the gun body (1), an end of the retainer (5) engaging with the slide stopper (3), and another end thereof connecting with a first magnetic member (51); and a rotary bullet supplier (6), received in the gun body (1), rotating relative to the retainer (5), and connecting with a second magnetic member (61);

wherein when the first magnetic member (51) attracts or repels the second magnetic member (61), the slide stopper (3) is driven to separate from the retainer (5) to make the return spring (4) push the slide stopper (3) to return toward the slide (2) until the slide stopper (3) engages with the slide (2).

2. The toy gun of claim 1, wherein the rotary bullet supplier (6) defines a rotation direction (d), and the first magnetic member (51) is extended with a magnetic extending section (511) in a direction which is opposite to the rotation direction (d).

3. The toy gun of claim 1, wherein the rotary bullet supplier (6) is a chain or a wheel, the rotary bullet supplier (6) is provided with bullet loading holes (62), and the second magnetic member (61) is inserted into one of the bullet loading holes (62).

4. The toy gun of claim 3, further comprising a restoring spring (7) which elastically supports between the gun body (1) and the retainer (5).

5. The toy gun of claim 1, wherein the slide stopper (3) is extended with a first block (31), the retainer (5) is extended with a second block (52) which movably engages with the first block (31).

6. The toy gun of claim 5, wherein the slide (2) is formed with recesses (21), the slide stopper (3) is extended with a stopping body (32) movably engaging with one of the recesses (21).

7. The toy gun of claim 6, wherein the slide stopper (3) is installed outside the gun body (1) and is capable of swaying relative to the slide (2), the gun body (1) is formed with an aperture (11), and the stopping body (32) is movably received in the aperture (11).

8. The toy gun of claim 7, wherein the second block (52) engages with the first block (31) when the stopping body (32) is received in the aperture (11).

9. The toy gun of claim 1, wherein the gun body (1) is formed with a first pivoting hole (12), the gun body (1) is further provided with a trigger (13) with a second pivoting hole (131), the slide stopper (3) is extended with a shaft (33), and the shaft (33) is rotatably received in both the first pivoting hole (12) and the second pivoting hole (131).

10. The toy gun of claim 9, wherein the return spring (4) is a torsion spring, and two ends of the return spring (4) are fixed to the trigger (13) and the shaft (33) respectively.

* * * * *